US011150021B2

(12) United States Patent
Moxley et al.

(10) Patent No.: US 11,150,021 B2
(45) Date of Patent: Oct. 19, 2021

(54) SYSTEMS AND METHODS FOR CASTING METALLIC MATERIALS

(75) Inventors: Travis R. Moxley, Kennewick, WA (US); Lanh G. Dinh, Richland, WA (US); Timothy F. Soran, Richland, WA (US); Edmund J. Haas, Benton City, WA (US); Douglas P. Austin, Benton City, WA (US); Matthew J. Arnold, Charlotte, NC (US); Eric R. Martin, Richland, WA (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

(21) Appl. No.: 13/081,740

(22) Filed: Apr. 7, 2011

(65) Prior Publication Data

US 2012/0255701 A1 Oct. 11, 2012

(51) Int. Cl.
*F27B 3/04* (2006.01)
*F27D 3/14* (2006.01)
(Continued)

(52) U.S. Cl.
CPC ..... *F27B 3/04* (2013.01); *B22D 11/001* (2013.01); *B22D 11/041* (2013.01);
(Continued)

(58) Field of Classification Search
CPC ..... B22D 11/116; B22D 21/005; C22B 9/228; F27D 3/14; F27D 11/12; F27B 3/04; F27B 3/045
(Continued)

(56) References Cited

U.S. PATENT DOCUMENTS 2,816,828 A 12/1957 Benedict et al.
3,342,250 A * 9/1967 Treppschuh et al. ..... 164/469
(Continued)

FOREIGN PATENT DOCUMENTS

EP 0124667 A2 11/1984
EP 0 896 197 A1 2/1999
(Continued)

OTHER PUBLICATIONS

Bakish, R., "The State of the art in Electron Beam Melting and Refining", JOM, Springer, New York LLC, United States, vol. 43(5), May 1, 1991, pp. 42-44.
(Continued)

*Primary Examiner* — Kevin E Yoon
*Assistant Examiner* — Jacky Yuen
(74) *Attorney, Agent, or Firm* — Robert J. Toth; K&L Gates LLP

(57) ABSTRACT

Certain embodiments of a melting and casting apparatus comprising includes a melting hearth; a refining hearth fluidly communicating with the melting hearth; a receiving receptacle fluidly communicating with the refining hearth, the receiving receptacle including a first outflow region defining a first molten material pathway, and a second outflow region defining a second molten material pathway; and at least one melting power source oriented to direct energy toward the receiving receptacle and regulate a direction of flow of molten material along the first molten material pathway and the second molten material pathway. Methods for casting a metallic material also are disclosed.

15 Claims, 7 Drawing Sheets

(51) Int. Cl.

| | |
|---|---|
| ***B22D 11/116*** | (2006.01) |
| ***F27D 11/12*** | (2006.01) |
| ***B22D 11/00*** | (2006.01) |
| ***B22D 11/041*** | (2006.01) |
| ***B22D 21/00*** | (2006.01) |
| ***B22D 11/14*** | (2006.01) |

(52) U.S. Cl.
CPC ..... *B22D 11/116* (2013.01); *B22D 11/141* (2013.01); *B22D 21/005* (2013.01); *F27D 3/14* (2013.01); *F27D 11/12* (2013.01)

(58) Field of Classification Search
USPC ..... 164/506, 512, 266, 322, 492, 494–495, 164/469–470, 453
See application file for complete search history.

(56) References Cited

U.S. PATENT DOCUMENTS

| | | | | |
|---|---|---|---|---|
| 3,343,828 | A * | 9/1967 | Hunt | 219/121.16 |
| 3,549,140 | A | 12/1970 | Joseph et al. | |
| 3,658,119 | A * | 4/1972 | Hunt et al. | 164/512 |
| 3,746,072 | A | 7/1973 | Richardson | |
| RE27,945 | E * | 3/1974 | Hunt et al. | B22D 11/113 164/258 |
| 4,027,722 | A | 6/1977 | Hunt | |
| 4,190,404 | A | 2/1980 | Drs et al. | |
| 4,372,542 | A | 2/1983 | Chia | |
| 4,376,649 | A | 3/1983 | Schwartz et al. | |
| 4,750,542 | A | 6/1988 | Harker et al. | |
| 4,823,358 | A * | 4/1989 | Aguirre et al. | 373/10 |
| RE32,932 | E * | 5/1989 | Harker et al. | 164/506 |
| 4,838,340 | A | 6/1989 | Entrekin et al. | |
| 4,839,904 | A | 6/1989 | Harberts et al. | |
| 4,932,635 | A | 6/1990 | Harker | |
| 4,936,375 | A | 6/1990 | Harker | |
| 4,961,776 | A | 10/1990 | Harker | |
| 5,040,773 | A | 8/1991 | Hackman | |
| 5,084,090 | A | 1/1992 | Harker | |
| 5,171,357 | A | 12/1992 | Aguirre et al. | |
| 5,171,358 | A | 12/1992 | Mourer | |
| 5,222,547 | A | 6/1993 | Harker | |
| 5,224,534 | A | 7/1993 | Shimizu et al. | |
| 5,263,689 | A | 11/1993 | Menzies et al. | |
| 5,273,101 | A | 12/1993 | Lillquist et al. | |
| 5,291,940 | A | 3/1994 | Borofka et al. | |
| 5,454,424 | A | 10/1995 | Mori et al. | |
| 5,503,655 | A | 4/1996 | Joseph | |
| 5,516,081 | A | 5/1996 | Mourer | |
| 5,972,282 | A * | 10/1999 | Aguirre et al. | 266/208 |
| 6,264,884 | B1 | 7/2001 | Grosse et al. | |
| 6,561,259 | B2 | 5/2003 | Spadafora et al. | |
| 6,824,585 | B2 | 11/2004 | Joseph et al. | |
| 6,868,896 | B2 | 3/2005 | Jackson et al. | |
| 7,137,436 | B2 * | 11/2006 | Jackson et al. | 164/469 |
| 7,470,305 | B2 * | 12/2008 | Jackson | B22D 41/00 164/14 |
| 7,559,353 | B2 | 7/2009 | Van Schooneveldt et al. | |
| 9,539,640 | B2 | 1/2017 | Copland et al. | |
| 2002/0104596 | A1 | 8/2002 | Crafton et al. | |
| 2002/0179278 | A1 * | 12/2002 | Spadafora | B22D 11/001 164/469 |
| 2013/0327493 | A1 | 12/2013 | Oda et al. | |
| 2014/0090792 | A1 | 4/2014 | Arnold | |
| 2015/0174654 | A1 | 6/2015 | Copland et al. | |
| 2015/0174655 | A1 | 6/2015 | Copland et al. | |
| 2016/0082508 | A1 | 3/2016 | Copland et al. | |

FOREIGN PATENT DOCUMENTS

| | | | |
|---|---|---|---|
| GB | 2 178 352 | A | 2/1987 |
| GB | 2 207 225 | A | 1/1989 |
| JP | 57-202483 | | 12/1982 |
| JP | 63-273555 | A | 11/1988 |
| JP | H04-131330 | A | 5/1992 |
| JP | 7-252544 | A | 10/1995 |
| JP | 2001-138036 | A | 5/2001 |
| JP | 2004-154788 | A | 6/2004 |
| JP | 2004-293927 | A | 10/2004 |
| JP | 2006-242475 | A | 9/2006 |
| JP | 2009-161855 | A | 7/2009 |
| JP | 2010-133651 | A | 6/2010 |
| JP | 2010132990 | A * | 6/2010 |
| RU | 2007108996 | A | 9/2008 |
| SU | 821040 | A | 4/1981 |
| SU | 1280901 | A1 | 10/1990 |
| SU | 1608021 | | 11/1990 |
| WO | WO 90/00627 | | 1/1990 |
| WO | WO 97/49266 | A1 | 12/1997 |
| WO | WO 01/18271 | | 3/2001 |
| WO | WO 2004/058431 | A2 | 7/2004 |
| WO | WO 2007/093135 | A1 | 8/2007 |

OTHER PUBLICATIONS

U.S. Appl. No. 13/759,370, filed Feb. 5, 2013.
Definition of hearth, http://www.thefreedictionary.com/hearth, 1991.
Fluid Dynamics, http://francesca.phy.cmich.edu/people/andy/physics110/book/Chapters/Chapters9.htm, date unknown, 10 pages.
English translation of non-patent literature of a third party submission of relevant art, Jun. 17, 2015, 14 pages.
Holz, Dr. Markus, ThyssenKrupp Titanium, The Global Titanium Market and the European Challenge, presented Oct. 2008 at International Titanium Conference 2008, Las Vegas, Nevada, USA, 34 pages.
VIM 100 to VIM 3000—ALD Vacuum Technologies India, ALD Vacuum Technologies GmbH, www.aldvt-india.com, 12 pages.

* cited by examiner

SYSTEMS AND METHODS FOR CASTING METALLIC MATERIALS

BACKGROUND OF THE TECHNOLOGY

Field of the Technology

The present invention relates to the field of metallurgy. In particular, the present invention is directed to improved casting systems and methods for the production of titanium alloys and other metallic materials.

Background of the Invention

Titanium and its alloys are highly important high performance materials used in numerous demanding applications, including military contracting, naval construction, aircraft construction, and other aerospace applications. Given the importance of these applications and the extreme conditions to which manufactured articles used in the applications are subjected, the mechanical and other characteristics of metals and metallic alloys (referred to collectively herein as "metallic materials") from which the articles are made are of substantial importance. There is often little allowance for variance in the characteristics of the metallic materials used in these applications. For example, the conventional practice of producing cast ingots from high performance titanium alloys includes time consuming and expensive techniques for detecting and removing inclusions and certain other casting defects from the cast ingots.

In general, inclusions are isolated particles suspended in the metallic matrix of a cast metallic material. In many cases, inclusions have a density differing from the density of the surrounding material and can have a significant deleterious effect on the overall integrity of the cast material. This, in turn, can cause a component comprised of the material to crack or fracture and, possibly, catastrophically fail. Unfortunately, inclusions in cast metallic materials generally are invisible to the human eye and, therefore, are very difficult to detect both during the manufacturing process and in the final component. Once an inclusion is detected, the nature of the inclusion and/or the mechanical requirements of the final component may dictate that all or a significant portion of the cast material is scrapped. In other cases, the discrete area of the inclusion may be removed by grinding or other machining operations, or the material may be relegated to less demanding applications. The process of detecting and removing inclusions in cast high performance titanium alloys and other cast metallic materials requires significant time, may be very costly, and may significantly reduce yield.

The presence of inclusions in a cast ingot is influenced by the manner in which the material is cast. For example, inclusions can be caused by inadequate or improper heating or mixing of the alloy during production. As such, improvements in the method of and equipment for casting ingots of titanium alloys and other metallic materials may reduce or eliminate the incidence of problematic inclusions in the castings.

SUMMARY OF THE INVENTION

One aspect of the present disclosure is directed to a melting and casting apparatus including a melting hearth, a refining hearth fluidly communicating with the melting hearth, and a receiving receptacle fluidly communicating with the refining hearth. The receiving receptacle includes a first outflow region defining a first molten material pathway, and a second outflow region defining a second molten material pathway. At least one electron beam gun is oriented to direct electrons toward the receiving receptacle and regulate a direction of flow of molten material along the first molten material pathway and the second molten material pathway.

An additional aspect of the present disclosure is directed to a melting and casting apparatus including a melting hearth, a refining hearth fluidly communicating with the melting hearth, and a receiving receptacle fluidly communicating with the refining hearth. The receiving receptacle includes a first outflow region defining a first molten material pathway, and a second outflow region defining a second molten material pathway. At least one melting power source is oriented to direct energy toward the receiving receptacle and regulate a direction of flow of molten material along the first molten material pathway and the second molten material pathway.

A further aspect of the present disclosure is directed to a method for casting a metallic material. The method includes providing a molten metallic material, and flowing the molten metallic material along a receiving receptacle including at least two outflow regions defining different molten material pathways, wherein each outflow region is associated with a different casting position. The method further includes selectively heating metallic material on one of the at least two outflow regions, thereby directing molten metallic material to flow along the flow pathway defined by the heated outflow region.

Further areas of applicability of the present invention will become apparent from the detailed description provided hereinafter. It should be understood that the detailed description and any specific examples herein, while indicating certain embodiment of the invention, are intended for purposes of illustration only and are not intended to limit the scope of the invention.

BRIEF DESCRIPTION OF THE DRAWINGS

The present invention will be more fully understood from the following detailed description and the accompanying drawings, which are not necessarily to scale, wherein.

DETAILED DESCRIPTION OF NON-LIMITING EMBODIMENTS OF THE INVENTION

Figure 1:
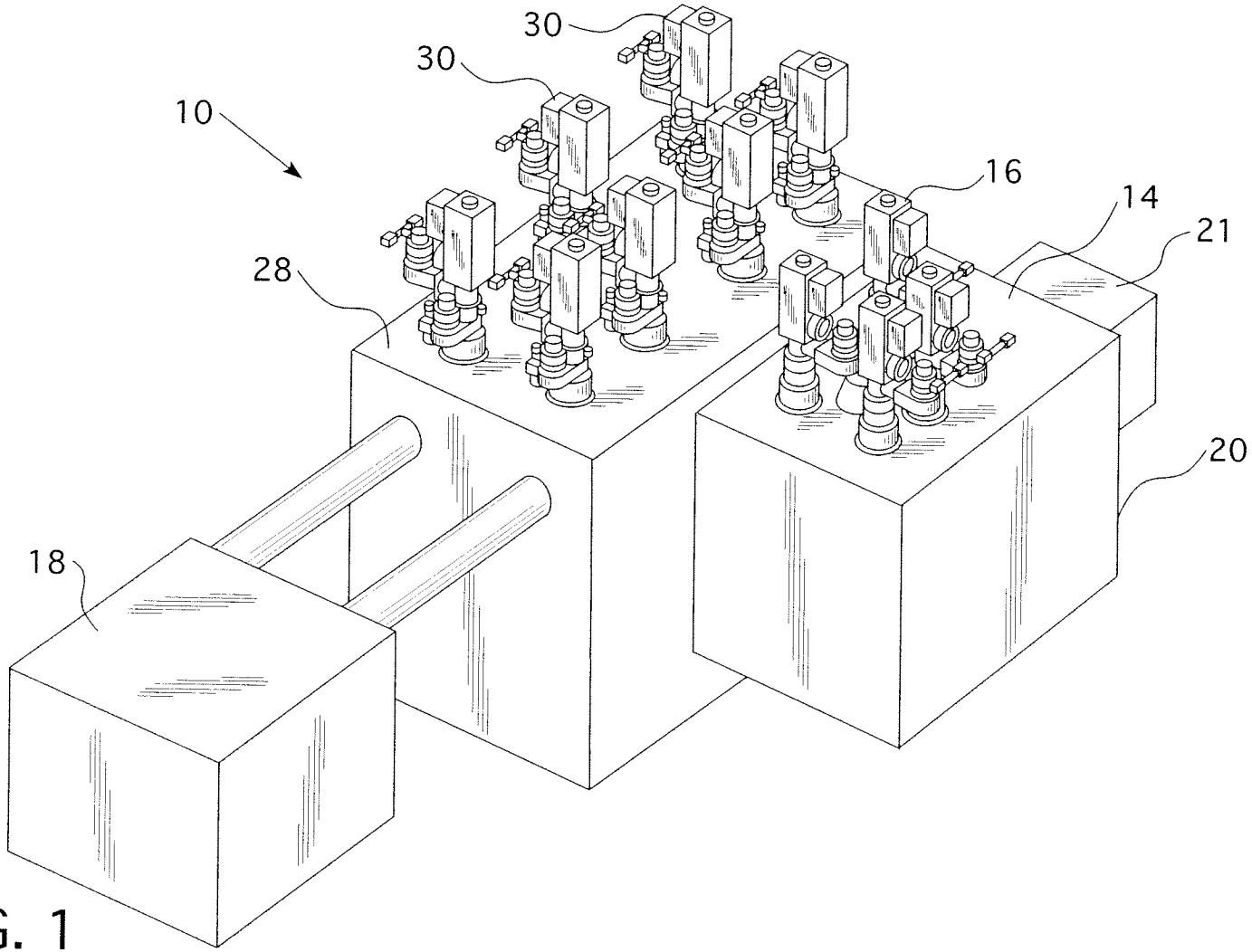
FIG. 1 is a schematic depiction of a non-limiting embodiment of an casting system according to the present disclosure, viewed from a first perspective.

As generally used herein, the articles "one", "a", "an", and "the" refer to "at least one" or "one or more", unless otherwise indicated.

As generally used herein, the terms "including" and "having" mean "comprising".

As generally used herein, the term "about" refers to an acceptable degree of error for the quantity measured, given the nature or precision of the measurement. Typical exemplary degrees of error may be within 20%, 10%, or 5% of a given value or range of values.

All numerical quantities stated herein are to be understood as being modified in all instances by the term "about" unless otherwise indicated. The numerical quantities disclosed herein are approximate and each numerical value is intended to mean both the recited value and a functionally equivalent range surrounding that value. At the very least, and not as an attempt to limit the application of the doctrine of equivalents to the scope of the claims, each numerical value should at least be construed in light of the number of reported significant digits and by applying ordinary rounding techniques. Notwithstanding the approximations of numerical quantities stated herein, the numerical quantities described in specific examples of actual measured values are reported as precisely as possible.

All numerical ranges stated herein include all sub-ranges subsumed therein. For example, a range of "1 to 10" is intended to include all sub-ranges between and including the recited minimum value of 1 and the recited maximum value of 10. Any maximum numerical limitation recited herein is intended to include all lower numerical limitations. Any minimum numerical limitation recited herein is intended to include all higher numerical limitations.

In the following description, certain details are set forth to provide a thorough understanding of various embodiments of the articles and methods described herein. However, one of ordinary skill in the art will understand that the embodiments described herein may be practiced without these details. In other instances, well-known structures and methods associated with the articles and methods may not be shown or described in detail to avoid unnecessarily obscuring descriptions of the embodiments described herein. Also, this disclosure describes various features, aspects, and advantages of various embodiments of articles and methods. It is understood, however, that this disclosure embraces numerous alternative embodiments that may be accomplished by combining any of the various features, aspects, and advantages of the various embodiments described herein in any combination or sub-combination that one of ordinary skill in the art may find useful.

The casting of ingots of, for example, titanium alloys and certain other high performance alloys, may be both expensive and procedurally difficult given the extreme conditions present during production and the nature of the materials included in the alloys. In many currently available cold hearth casting systems, for example, either plasma arc melting in an inert atmosphere or electron beam melting within a vacuum melt chamber is used to melt and mix recycled scrap, master alloys, and other starting materials to produce the desired alloy. Both of these casting systems utilize materials that can contain high density or low density inclusions, which in turn can lead to a lower quality and potentially unusable heat or ingot. Cast material considered unusable oftentimes can be melted down and reused, but such material typically would be considered of lesser quality and command a lower price in the marketplace. As a result, alloy producers assume significant monetary risk on each heat/ingot based on the expected input material into plasma and electron beam casting systems.

In casting systems utilizing plasma arc melting or electron beam melting, the improper application of torch or gun power may result in under-heating or over-heating, and can produce conditions under which inclusions can survive in the melted product. Certain types of these inclusions are a result of contact between base alloy material and atmospheric gasses (e.g., nitrogen and oxygen). Electron beam cold hearth casting systems were developed to reduce the possibility that these inclusions would survive into the final melted product.

Electron beam cold hearth casting systems typically utilize a copper hearth incorporating a fluid-based cooling system to limit the temperature of the hearth to temperatures below the melting temperature of the copper material. Although water-based cooling systems are the most common, other systems, such as argon-based cooling systems, may be incorporated into a cold hearth. Cold hearth systems, at least in part, use gravity to refine molten metallic material by removing inclusions from the molten material resident within the hearth. Relatively low density inclusions float for a time on the top of the molten material as the material is mixed and flows within the cold hearth, and the exposed inclusions may be remelted or vaporized by one or more of the casting system's electron beams. Relatively high density inclusions sink to the bottom of the molten material and deposit close to the copper hearth. As molten material in contact with the cold hearth is cooled through action of the hearth's fluid-based cooling system, the materials freeze to form a solid coating or "skull" on the bottom surface of the hearth. The skull protects the surfaces of the hearth from molten material within the hearth. Entrapment of inclusions within the skull removes the inclusions from the molten material, resulting in a higher purity casting.

Although electron beam cold hearth casting systems offer many advantages, such systems can only produce one run or ingot of molten material at a time. Once the withdrawal length has been reached inside the casting mold of the melt system, the run is completed and the casting system is taken off line and is prepared for the next run and ingot. Preparation for the next casting run includes stopping the flow of molten material to the crucible and cooling and solidifying the ingot prior to fully extracting the ingot from casting mold system. During cooling of the internal melting system between casting runs, deposits formed on the internal melt chamber walls can loosen and drop into the hearth. These deposits may be incorporated into molten material resident in the hearth in subsequent runs and be incorporated into ingots produced in those runs. This poses a significant quality control problem in the subsequent melt runs/ingots within a melting system cycle.

A well-mixed molten alloy produces a more compositionally uniform final cast product. Further, much like current plasma-heated systems, stopping the casting process between or during melt cycles can result in conditions conducive to variability in chemistry of compositions cast in subsequent runs/heats. For example, interruptions in the operation of conventional electron beam casting systems may promote aluminum vaporization and deposition of aluminum condensates on cooler surface within the vacuum melting chamber during the production of titanium alloy castings. The condensates may drop back into the molten material, potentially resulting in aluminum-rich inclusions in the final casting.

Embodiments of electron beam cold hearth casting systems according to the present disclosure address drawbacks associated with conventional electron beam cold hearth casting systems. According to a non-limiting embodiment of the present disclosure, a casting system includes: a melting chamber; a melting hearth disposed within the melting chamber and in which starting materials are melted; a refining hearth, which may be a cold hearth, fluidly communicating with the melting hearth; a receiving receptacle fluidly communicating with the refining hearth; a at least one melting power source; a vacuum generator; a fluid-based cooling system; a plurality of casting molds; and a power supply. In one non-limiting embodiment of the present disclosure, the casting system includes: a melting chamber; a melting hearth disposed within the melting chamber and in which starting materials are melted; a refining hearth, which preferably is a cold hearth, fluidly communicating with the melting hearth; a receiving receptacle fluidly communicating with the refining hearth; a plurality of (i.e., two or more) electron beam guns; a vacuum generator; a fluid-based cooling system; a plurality of casting molds; and a power supply. While the design of the melting furnaces and casting systems and the various involved components described herein may be secured from any suitable provider, possible providers will be apparent to those having ordinary skill upon reading the present description of the subject matter herein.

Although the following non-limiting embodiment of a casting system according to the present disclosure described below and illustrated in certain of the accompanying figures incorporates one or more electron beam guns, it will be understood that other melting power sources could be used in the casting system as material heating devices. For example, the present disclosure also contemplates a casting system using one or more plasma generating devices that generate an energetic plasma and heat metallic material within the casting system by contacting the material with the generated plasma.

As is known to those having ordinary skill, the melting hearth of an electron beam casting system fluidly communicates with a refining hearth of the system via a molten material flow path. Starting materials are introduced into the melting chamber and the melting hearth therein, and one or more electron beams impinge on and heat the materials to their melting points. To allow for proper operation of the one or more electron beam guns, at least one vacuum generator is associated with the melting chamber and provides vacuum conditions within the chamber. In certain non-limiting embodiments, an intake area also is associated with the melting chamber, through which starting materials may be introduced into the melting chamber and are melted and initially disposed within the melting hearth. The intake area may include, for example, a conveyer system for transporting materials to the melting hearth. As is known in the art, starting materials that are introduced into the melting chamber of a casting system may be in a number of forms such as, for example, loose particulate material (e.g., sponge, chips, and master alloy) or a bulk solid that has been welded into a bar or other suitable shape. Accordingly, the intake area may be designed to handle the particular starting materials expected to be utilized by the casting system.

Once the starting materials are melted in the melting hearth, the molten material may remain in the melting hearth for a period of time to better ensure complete melting and homogeneity. The molten material moves from the melting hearth to the refining hearth via a molten material pathway. The refining hearth may be within the melting chamber or another vacuum enclosure and is maintained under vacuum conditions by the vacuum system to allow for proper operation of one or more electron beam guns associated with the refining hearth. While gravity-based movement mechanisms may be used, mechanical movement mechanisms also may be used to aid in the transport of the molten material from the melting hearth to the refining hearth. Once the molten material is disposed in the refining hearth, the material is subjected to continuous heating at suitably high temperatures by at least one electron beam gun for a sufficient time to acceptably refine the material. The one or more electron beam guns, again, are of sufficient power to maintain the material in a molten state in the refining hearth, and also are of sufficient power to vaporize or melt inclusions that appear on the surface of the molten material.

The molten material is retained in the refining hearth for sufficient time to remove inclusions from and otherwise refine the material. Relatively long or short residence times within the refining hearth may be selected depending on, for example, the composition and the prevalence of inclusions in the molten material. Those having ordinary skill may readily ascertain suitable residence times to provide appropriate refinement of the molten material during casting operations. Preferably, the refining hearth is a cold hearth, and inclusions in the molten material may be removed by processes including dissolution in the molten material, by falling to the bottom of the hearth and becoming entrained in the skull, and/or by being vaporized by the action of the electron beams on the surface of the molten material. In certain embodiments, the electron beam guns directed toward the refining hearth are rastered across the surface of the molten material in a predetermined pattern to create a mixing action. One or more mechanical movement devices optionally may be provided to provide the mixing action or to supplement the mixing action generated by rastering the electron beams.

Once suitably refined, the molten material passes via gravity and/or by mechanical means along the molten material pathway to a receiving receptacle fabricated from materials that will withstand the heat of the molten material. In one non-limiting arrangement, the receiving receptacle is within the vacuum chamber surrounding the melting hearth and refining hearth and is maintained under vacuum conditions during casting. In an alternative embodiment, the receiving receptacle is within a separate casting chamber and is maintained under vacuum conditions. The receiving receptacle may be maintained under vacuum conditions by its own vacuum generator or may rely on the vacuum generated by the one or more vacuum generators providing vacuum conditions to the chamber enclosing the melting hearth and/or refining hearth. One or more electron beam guns are positioned on the enclosure surrounding the receiving receptacle and impinge electron beams on the molten material in the receiving receptacle, thereby maintaining the material in the receiving receptacle in a molten state. As noted above, it is contemplated that alternative melting power sources such as, for example, plasma generating devices, could be used in the casting system as material heating devices to heat and/or refine the metallic material by application of energetic plasma.

Figure 2:
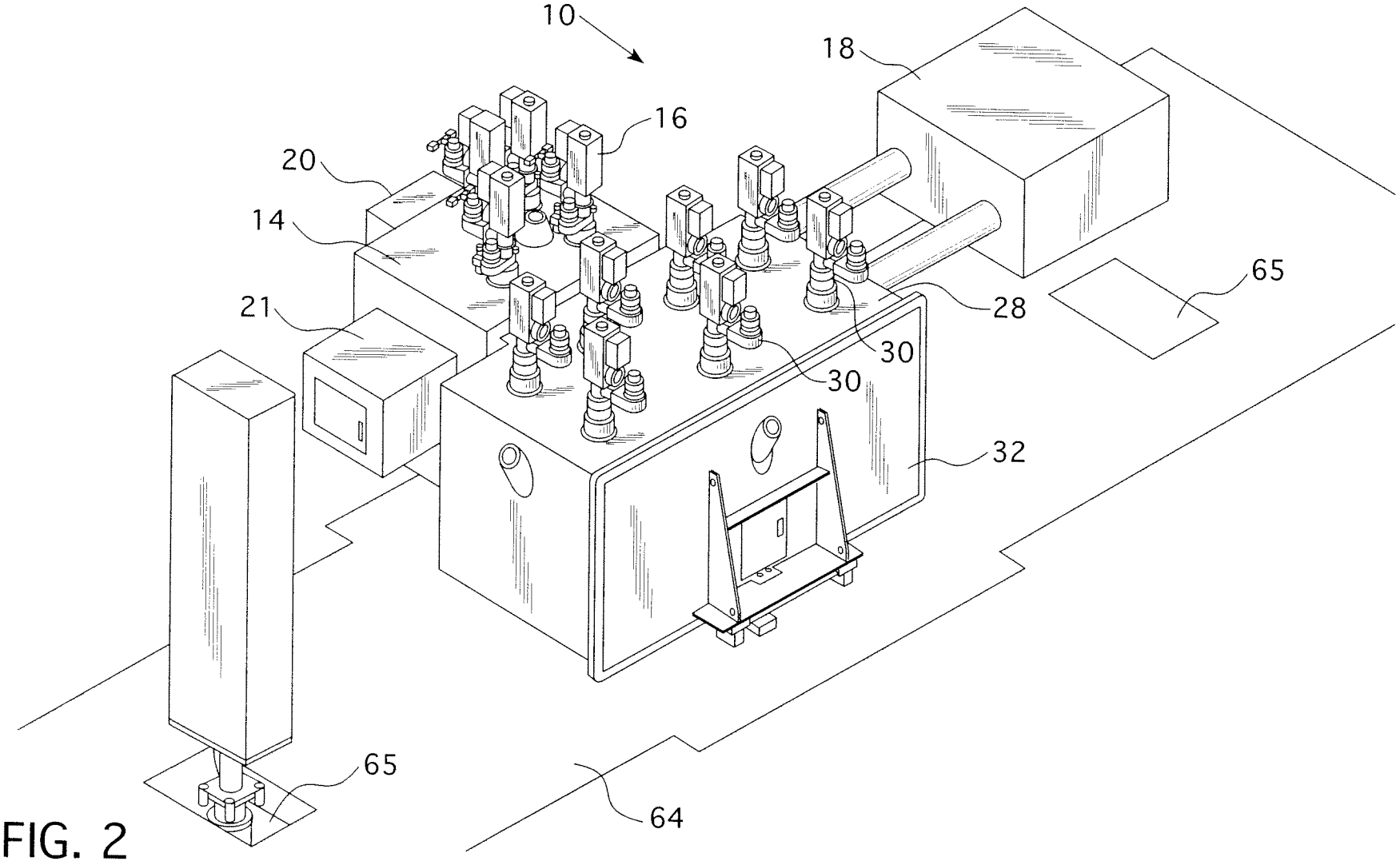
FIG. 2 is a schematic depiction of the casting system shown in FIG. 1, viewed from a second perspective and showing a cast ingot.
Figure 3:
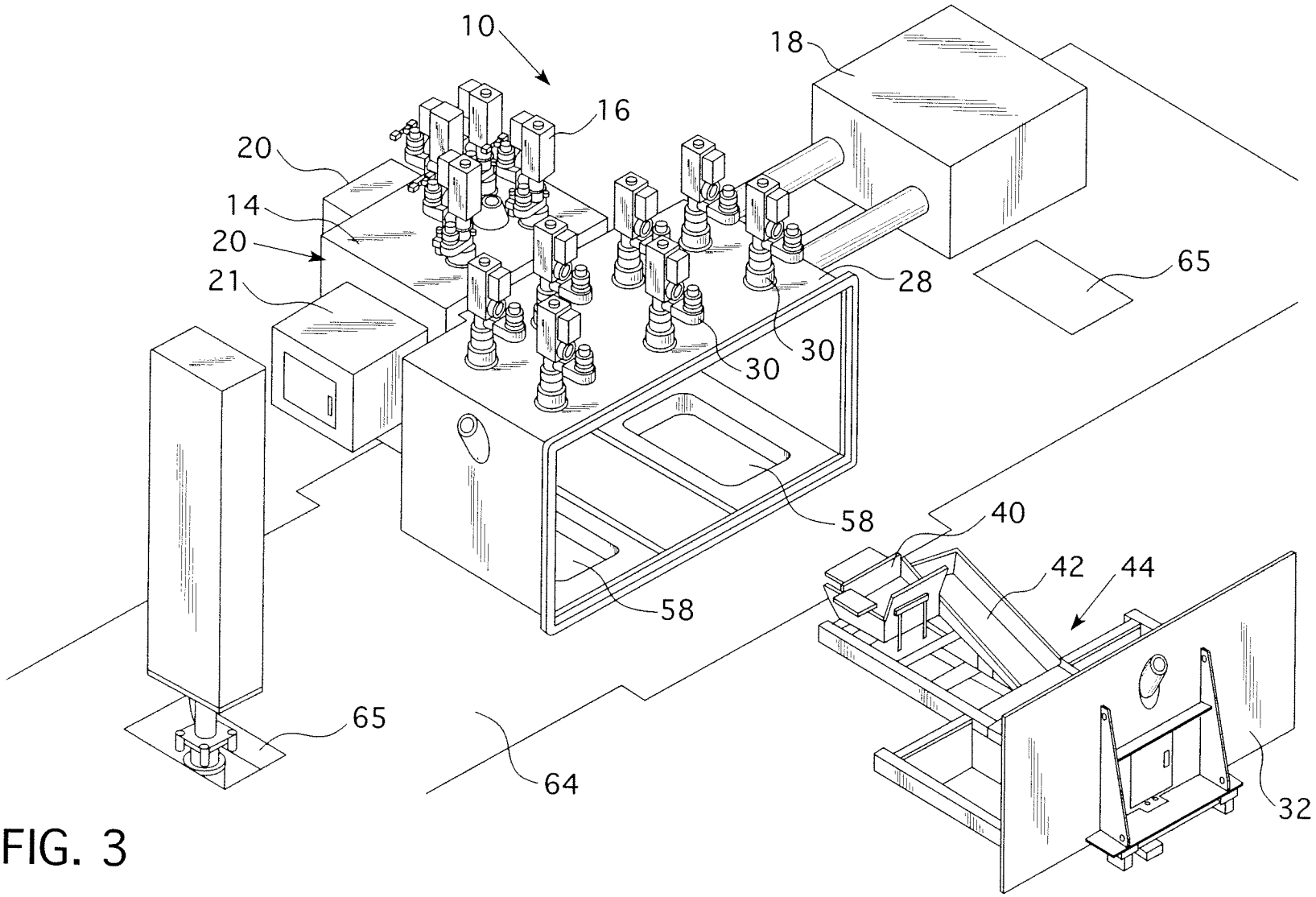
FIG. 3 is a schematic depiction of the casting system shown in FIG. 1, viewed from the perspective of FIG. 2, but wherein the a wall of the casting chamber and associated chambers and pathways has been moved back to expose an interior of the casting chamber.

The arrangement of elements described above may be better understood by reference to FIGS. 1-3, which schematically depict a non-limiting embodiment of a casting system 10 according to the present disclosure. Casting system 10 includes melting chamber 14. A plurality of melting power sources in the form of electron beam guns 16 are positioned about melting chamber 14 and are adapted to direct electron beams into the interior of melting chamber 14. Vacuum generator 18 is associated with melting chamber 14. Casting chamber 28 is positioned adjacent melting chamber 14. Several electron beam guns 30 are positioned on casting chamber 28 and are adapted to direct electron beams into the interior of the casting chamber 28. Starting materials, which may be in the form of, for example, scrap material, bulk solids, master alloys, and powders, may be introduced into melting chamber 14 through one or more intake areas providing access to the interior of the chamber. For example, as shown in FIGS. 1-3, each of intake chambers 20 and 21 includes an access hatch and communicates with the interior of melting chamber 14. In certain non-limiting embodiments of casting system 10, intake chamber 20 may be suitably adapted to allow introduction of particulate and powdered starting material into melting chamber 14, and intake chamber 21 may be suitably adapted to allow introduction of bar-shaped and other bulk solid starting material into melting chamber 14. (Intake chambers 20 and 21 are only shown in FIGS. 1-3 in order to simplify the accompanying figures.)

Figure 4B:
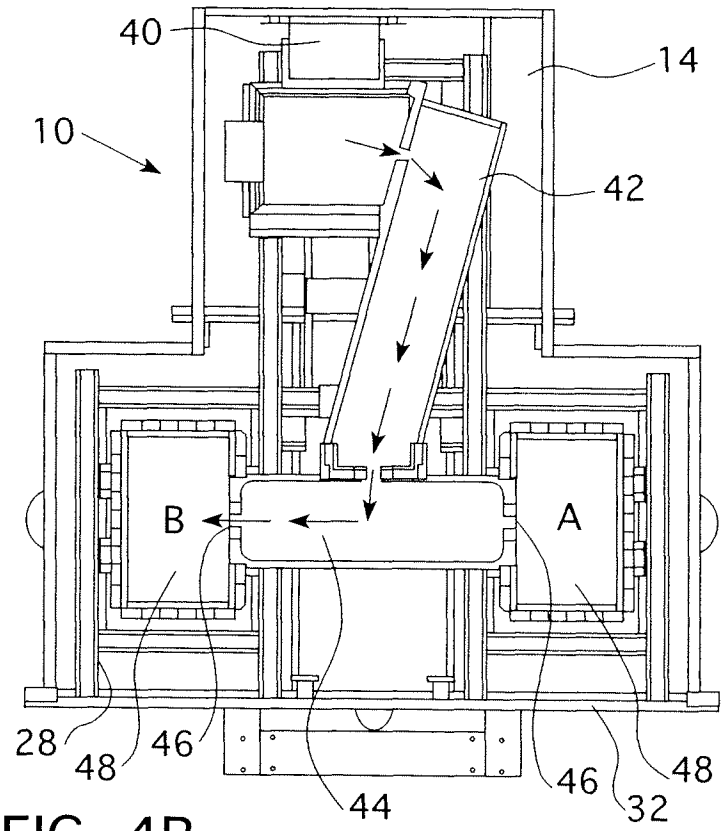
FIGS. 4A and 4B are top views schematically depicting the interior of the melting chamber and the casting chamber of the casting system shown in FIG. 1, and wherein alternate molten material flow paths from a receiving receptacle into alternate crucibles are indicated.
Figure 4A:
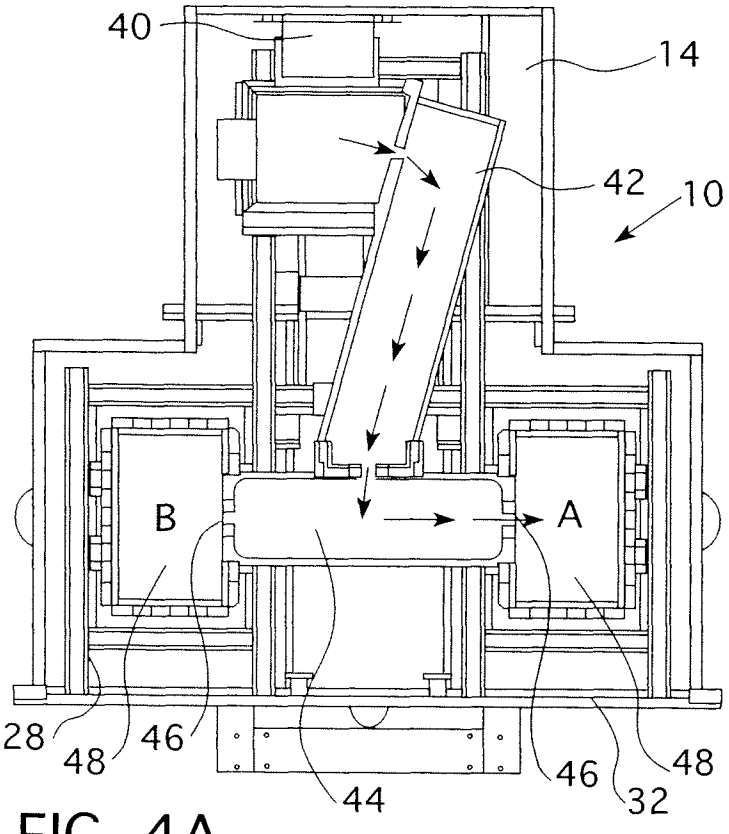

As shown in FIG. 3, a translatable side wall 32 of casting chamber 28 may be detached from the casting chamber 28 and moved away from the casting system 10, exposing the interior of the casting chamber 28. The melting hearth 40, refining hearth 42, and receiving receptacle 44 are connected to the translatable side wall 32 and, thus, the entire assemblage of translatable side wall 32, melting hearth 40, refining hearth 42, and receiving receptacle 44 may be moved away from the casting system 10, exposing the interior of the casting chamber 28. The arrangement of melting hearth 40, refining hearth 42, and receiving receptacle 44 can be seen in FIG. 3, as well as in FIGS. 4A and 4B. FIGS. 4A and 4B are top views showing the interior of the melting chamber 14 and the casting chamber 28 with the translatable side wall 32 and the associated melting hearth 40, refining hearth 42, and receiving receptacle 44 in place in the casting system 10. The translatable side wall 32 may be moved away from the casting chamber 28 to allow access to any of the melting hearth 40, refining hearth 42, and receiving receptacle 44, for example, and to access the interior of the melting chamber 14 and casting chamber 28. Also, after one or more casting runs, a particular assemblage of a translatable side wall, melting hearth, refining hearth, and receiving receptacle may be replaced with a different assemblage of those elements.

With particular reference to FIGS. 4A and 4B, molten material flows from the receiving receptacle 44 into one or the other of two casting molds 48, labeled "A" and "B", positioned on opposed sides of the receiving receptacle 44. Thus, the receiving receptacle 44 "receives" molten material from the refining hearth 42 and conveys it to a selected casting mold 48. Preferably, the receiving receptacle 44 is stationary or fixed relative to the refining hearth 42, rather than being a "tilting" receptacle, as it has been observed that a receiving receptacle adapted to tilt to one or the other side results in additional wear and, therefore, may require more frequent maintenance. In certain non-limiting embodiments, the receiving receptacle 44 includes high sidewalls to better prevent splashing and spillage, as well as two oppositely positioned pour spouts 46. During casting operations, each spout 46 is positioned above the opening of a withdrawal mold or another type of casting mold or crucible for casting the molten material into an ingot or other cast article. In one possible non-limiting arrangement, at least one electron beam gun is positioned above the receiving receptacle 44, and in certain embodiments is generally equidistant between each pour spout 46 and the center of the receiving receptacle 44, so that the electron beam emitted by each of the two electron beam guns may impinge on material on one half of the receiving receptacle 44.

One possible non-limiting arrangement of the melting hearth 40, refining hearth 42, and receiving receptacle 44 is shown in FIGS. 4A and 4B, and is partially shown in FIG. 3. The refining hearth 42 fluidly communicates with a central region of a side of the receiving receptacle 44. The receiving receptacle 44 includes a pour spout 46 at each of its opposed ends, and a casting mold 48 may be positioned under each spout 46. The orientation of the refining hearth 42 relative to the receiving receptacle 46 generally forms a "T" shape when viewed from above. As shown in the non-limiting embodiment of FIGS. 4A and 4B, the casting molds 48 may be positioned next to the receiving receptacle 44 so that the molds 48 receive molten material from the receiving receptacle 44 without the need for the receiving receptacle 44 to tip to reach the molds 48. In certain non-limiting embodiments, the casting molds 48 are placed at a distance apart that is selected to prevent molten or partially molten material intended to be cast in one particular casting mold 48 from splashing into the other casting mold. This arrangement allows for better control of chemistry and heat distribution in the ingot or other cast article during casting. The generally T-shaped arrangement of refining hearth 42 and receiving crucible 44, wherein spouts 46 are on opposed ends of the receiving crucible 46, allows the casting molds 48 to be spaced apart at a distance better ensuring that splashed molten or partially molten material intended for one casting mold 48 will not enter the other casting mold 48.

As shown in FIGS. 4A and 4B, molten material may flow to one or the other of the casting molds 48 by selecting either one or the other molten material flow path. FIG. 4A illustrates a molten material pathway from melting hearth 40, to refining hearth 42, to receiving receptacle 44, and then along a first outflow region defined by the right region (as oriented in the figure) of receiving receptacle 44, to flow from the pour spout 46 on the right region of the receiving receptacle 44 into casting mold A. An alternative molten material flow path is shown in FIG. 4B, wherein molten material flows from melting hearth 40, to refining hearth 42, to receiving receptacle 44, and then along a second outflow region defined by the left region (as oriented in the figure) of receiving receptacle 44, to flow from the pour spout 46 on the left region of the receiving receptacle 44 into casting mold B.

Casting system 10 may be constructed so that molten material will flow only along one desired flow path to one or the other (left or right) pour spout 46 along a particular desired flow path A or B. The electron beam guns 30 within the casting chamber 28 are arranged so that when activated, an emitted electron beam will excite, and thereby heat and maintain in a molten state, material on only one or the other side, or on both sides, of the receiving receptacle 44, opening only flow path A, only flow path B, or both flow paths. Preferably, when one electron beam gun is active and heats the material along one flow path on the receiving receptacle 44, the other electron beam gun is inactive and does not heat the material along the other flow path on receiving receptacle 44. The molten material on the side of the receiving receptacle 44 that is not heated by an active electron beam gun cools and solidifies, creating a dam preventing flow of molten material along that unheated flow path. Accordingly, the molten material is directed to flow toward the side of the receiving receptacle 44 that is actively heated by an electron beam and into an adjacent casting mold 48 along only the flow path that traverses that side of the receiving receptacle. Of course, a casting system according to the present disclosure that incorporates melting power sources other than electron beam guns (such as, for example, plasma generating devices) as material melting devices may operate in a similar fashion by utilizing the particular melting power as a material heating device to selectively heat material on a region of the receiving receptacle to allow molten material to flow only along a particular desired flow path.

An operator may select a first flow path and then, subsequently, a second flow path during a particular casting run, thereby allowing one casting run to include, for example, casting of a first ingot or other cast article in a first casting mold (such as the casting mold 48 labeled "A" in FIG. 4A), followed in time by casting of a second ingot or other cast article in a second casting mold (such as the casting mold 48 labeled "B" in FIG. 4B). Such an operation may be continuous, without the need to take the casting system 10 off line during the casting of successive ingots or other cast articles in a first casting mold, a second casting mold, etc.

Figure 5:
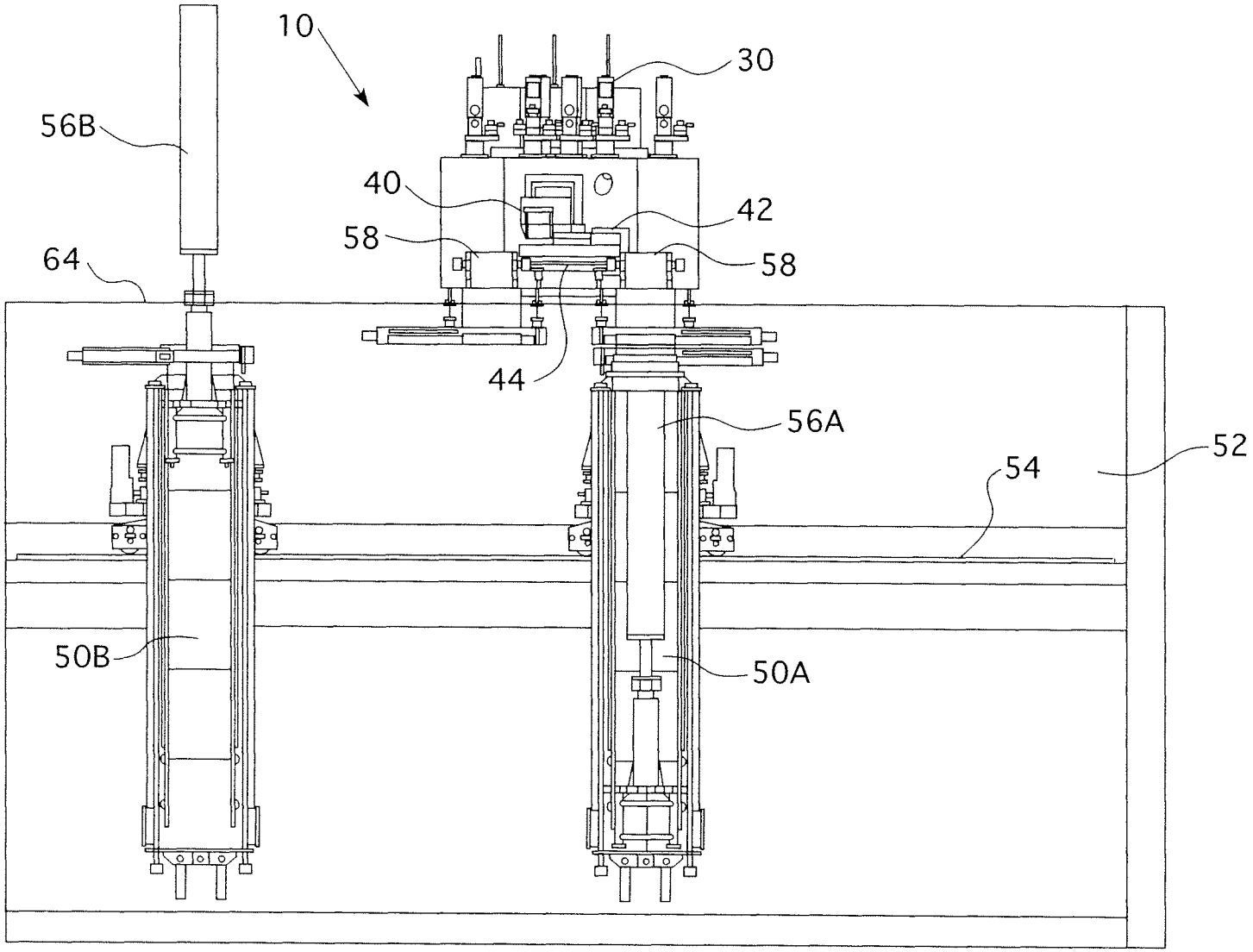
FIG. 5 is a front elevational view of the casting system shown in FIG. 1, wherein individual casting molds within a subfloor passageway are shown.
Figure 6:
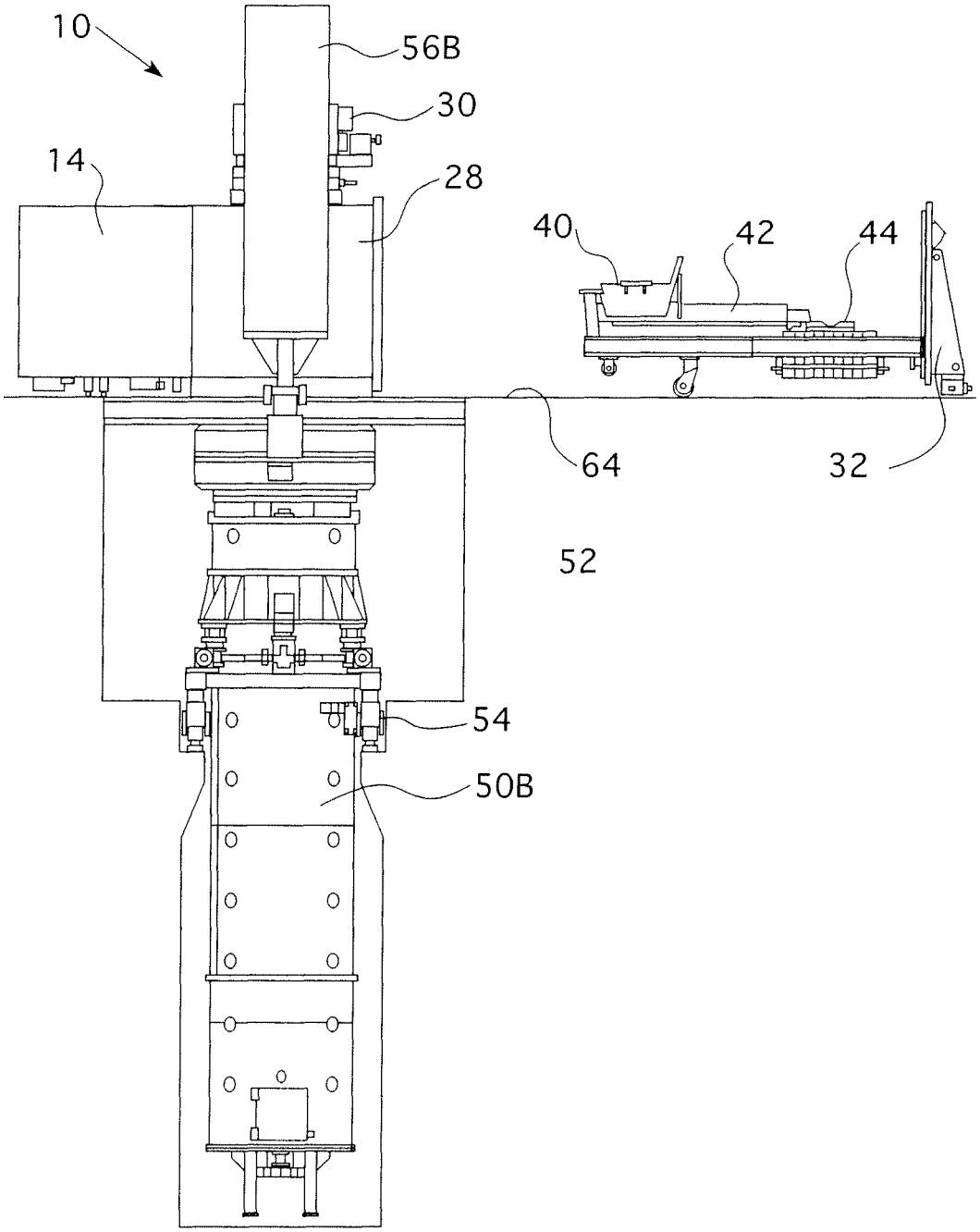
FIG. 6 is a side elevational view of the casting system shown in FIG. 1, wherein an individual casting mold within a subfloor passageway is shown.

Also, given that only one of the casting molds will be used at any one time during such a continuous casting run of two or more ingots or other cast articles, the one or more casting molds that are not currently being used may be readied to receive molten material while a different casting mold is in use. This feature of casting system 10 also allows for the casting of more than two ingots or other cast shapes in a single casting run. To allow for casting in this way, one casting mold may be readied to receive molten material while another casting mold is in use. In another possible arrangement, more than two casting molds may be available for use and successively positioned under one or the other spout 46 of the receiving receptacle 44 during a casting run. One possible non-limiting arrangement is schematically depicted in FIGS. 5 and 6 in connection with casting apparatus 10. FIG. 5 is a front elevational view of casting system 10 in which two translatable withdrawal molds 50A and 50B are shown disposed within a sub-floor passageway 52 beneath floor surface 64. The passageway 52 also is shown in FIG.3. The ingot molds 50A and 50B may translate along rail system 54 within sub-floor passageway 52. Translatable casting chamber wall 32 is absent in FIG. 5 to reveal the interior of the casting and melting chambers 14,28, and the melting hearth 40, refining hearth 42, and receiving receptacle 44 therein. In FIG. 5, withdrawal mold 50A is shown positioned to receive molten material flowing along the right region of the receiving receptacle 44, through casting port 58, and into the withdrawal mold 50A to form alloy ingot 56A. Those having ordinary skill will readily understand the general design and mode of operation of a withdrawal mold without the need for further description herein.

Again referring to FIGS. 3, 5, and 6, once a particular withdrawal mold is filled with molten material, that withdrawal mold may be translated on rail system 54 away from the particular casting port 58 (see FIG. 3) in the casting chamber 28 through which molten material flowed into the withdrawal mold from the receiving receptacle 44. The cast ingot may then be removed from the withdrawal mold, such as by extending the cast ingot from the withdrawal mold, and the mold may be prepared to be re-positioned under a casting port 58 to again receive molten material and cast an additional ingot. In FIGS. 3, 5, and 6, for example, withdrawal mold 50B is shown translated away from a casting port 58 along rail system 54 to a side area of the subfloor region 52, allowing the cast ingot 56B to be removed from the withdrawal mold 50B through an ingot extraction port 65 in the floor surface 64 that forms the ceiling of the sub-floor passageway 52.

The possibility of casting two or more ingots or other cast shapes in a single casting run is particularly advantageous in that operating the casting system 10 in a continuous manner reduces down time and may improve casting yield and quality. Continued use of casting molds in the manner contemplated in the above description during a casting run allows for a reduction in the disadvantageous thermal cycling that occurs through changes in equipment temperature resulting from shutting down and restarting the casting system. For example, reducing thermal cycling may significantly reduce aluminum vaporization when, for example, casting an aluminum-containing titanium alloy or another aluminum-containing alloy. Vaporized aluminum may condense on cooler surfaces within the melting and casting chambers of the casting system, and the aluminum condensates may fall back into the molten material, creating problematic variations in the final cast product. The ability to run the casting system described herein in a continuous fashion allows a high temperature to be maintained in the interior of the melting and casting chambers for a longer period of time, better preventing cooling of interior surfaces and formation of aluminum and other condensates on those surfaces. In turn, it is less likely that the condensates will be incorporated into the final castings as problematic to the chemical composition of the cast ingot. In addition, because the interior of the casting chamber need not be accessed as frequently as systems allowing a shorter casting run, there is more productive operation of the casting system.

As discussed previously, although the above description of certain embodiments describes a casting system that utilizes electron guns as melting power sources to melt and refine the metallic material and to regulate flow of the molten material along the receiving receptacles possible flow paths, it will be understood that other melting power sources may be used. For example, the electron guns discussed above in connection with casting system 10 may be replaced with plasma generating devices to heat and/or refine material in the casting system by directing energetic plasma toward the material, or other suitable melting power sources may be used as material heating devices. Those having ordinary skill are familiar with the possible use of plasma generating devices and other alternative melting power sources to heat and refine metallic materials.

Figure 7A:
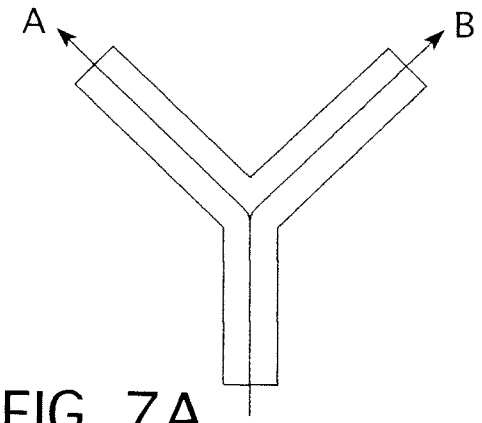
FIGS. 7A through 7E schematically depict top views of various alternative embodiments of receiving receptacle configurations according to the present disclosure.
Figure 7B:
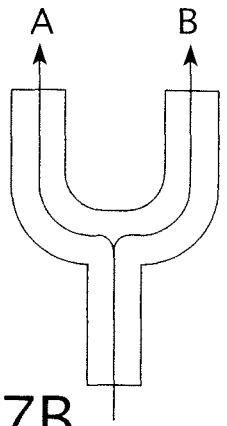
Figure 7C:
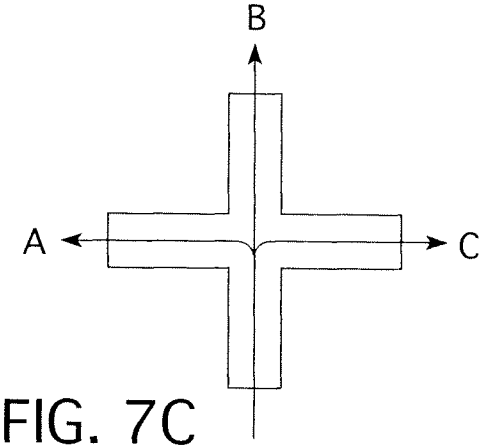
Figure 7D:
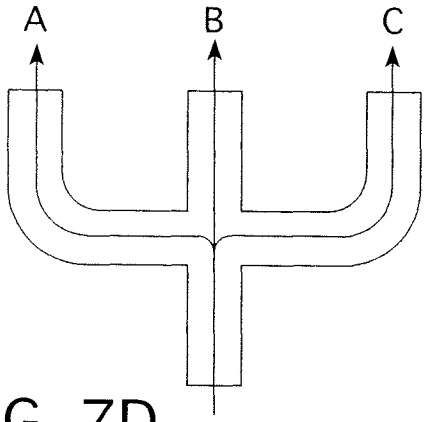
Figure 7E:
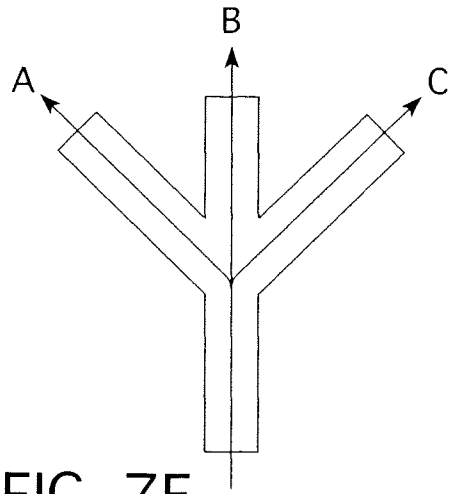

Although a particular generally T-shaped arrangement of the refining embodiment of the receiving receptacle is depicted in the figures and is discussed in the above description of certain non-limiting embodiments of a casting system according to the present disclosure, it will be understood that the receiving receptacle may have any shape and construction that allows for selection of one or more of two or more possible flow paths be selectively controlling the heating of material along the various flow paths. Possible non-limiting alternative shapes of a receiving receptacle according to the present disclosure include various generally Y-shaped receiving receptacles (FIGS. 7A and 7B, for example), cross-shaped receiving receptacles (FIG. 7C, for example), and fork-shaped receiving receptacles (FIGS. 7D and 7E, for example). The generally Y-shaped non-limiting embodiments illustrated in FIG. 7A provide two possible flow paths "A" and "B", while the non-limiting embodiments shown in FIGS. 7C-7E provide three possible flow paths "A", "B", and "C". The particular melting power sources used as material heating devices in the casting system, whether electron beam guns, plasma generating devices, or otherwise, may be selectively energized and trained on or otherwise adapted to heat one or more of the flow paths of any of these receiving receptacle embodiments to heat material and allow molten material to flow along the selected flow path(s) and into an adjacent casting mold. It will be understood, for example, that a casting system associated with the non-limiting receiving receptacle embodiments shown in FIGS. 7C-E may include a casting mold position adjacent to each of the three outflow paths "A", "B", and "C". In such an arrangement, for example, casting molds positioned or to be positioned to receive molten material from flow paths "A" and "B" may be readied while molten material is being cast in a casting mold positioned at flow path "C". For example, if in a particular casting system or casting run it takes a significant time to remove an ingot or other casting from a casting mold after the flow of molten material to the mold ceases, it may be desirable to provide three or more casting positions and associated casting molds so as to always allow a casting mold to be ready to receive molten material once a mold has been filled. In that case, the receiving receptacle may be designed to provide a flow path to each of the three or more casting positions, and associated melting power sources would regulate the flow of molten material along the several flow paths.

One having ordinary skill, upon reading the present disclosure, will understand that a receiving receptacle of a casting system according to the present disclosure may be designed to include any suitable number of flow paths. However, given that there may be advantages to separating the outflow paths in space to prevent molten material from inadvertently entering a casting mold or impinging on a casting position that is not in use, and further given the expense associated with including additional casting positions, it is likely that casting systems according to the present disclosure will include two or three casting positions and a receiving receptacle shaped to allow a flow path to each such casting position.

Embodiments of a casting system according to the present disclosure may be adapted for the casting of various metals and metallic alloys. For example, embodiments of casting systems according to the present disclosure may be adapted to the casting of: commercially pure (CP) titanium grades; titanium alloys including, for example, titanium-palladium alloys and titanium-aluminum alloys such as Ti-6Al-4V alloy, Ti-3Al-2.5V alloy, and Ti-4Al-2.5V alloy; niobium alloys; and zirconium alloys. One particular Ti-4Al-2.5V alloy that may be processed by casting systems and the associated casting methods according to the present disclosure is commercially available as ATI® 425® alloy from Allegheny Technologies Incorporated, Pittsburgh, Pa. USA.

The present disclosure also is directed to a method for casting a metallic material. The method includes providing a molten metallic material, and flowing the molten metallic material along a receiving receptacle including at least two outflow regions defining different molten material pathways. Each of the different outflow regions of the receiving receptacle is associated with a different casting position at which a casting apparatus may be positioned for casting a molten metallic material. Metallic material on one of the at least two outflow regions is selectively heated to melt the metallic material on the selected outflow region and/or maintain the metallic material on the selected outflow region in a molten state, thereby directing molten metallic material to flow along the flow pathway defined by the heated outflow region. In certain embodiments, the method includes heating starting materials selected to provide a desired composition of the molten metallic material. As mentioned above, in certain embodiments, the metallic material has a composition selected from a commercially pure titanium grade, a titanium alloy, a titanium-palladium alloy, a titanium-aluminum alloy, Ti-6Al-4V alloy, Ti-3Al-2.5V alloy, Ti-4Al-2.5V alloy, a niobium alloy, and a zirconium alloy. In certain non-limiting embodiments of a method according to the present disclosure, the receiving receptacle includes at least three outflow regions, and the method includes selectively heating metallic material disposed on one of the at least three outflow regions, thereby directing molten metallic material to flow along the flow pathway defined by the heated outflow region.

In certain non-limiting embodiments of a method according to the present disclosure, the step of providing a molten metallic material includes heating starting materials selected to provide a desired composition of the molten metallic material. In certain non-limiting embodiments of a method according to the present disclosure, the step of providing a molten metallic material further includes refining the molten metallic material. In certain non-limiting embodiments of a method according to the present disclosure, each molten material pathway includes a melting hearth and/or a refining hearth, in addition to the receiving receptacle. In certain non-limiting embodiments of a method according to the present disclosure, the step of selectively heating metallic material on the selected outflow region of the receiving receptacle includes heating the metallic material with at least one of an electron beam gun and a plasma generating device. However, it will be understood that other suitable melting power sources may be used as material heating devices. Certain non-limiting embodiments of a method according to the present disclosure include the additional step of casting the molten metallic material in a casting apparatus at the casting position associated with the heated outflow region. In certain embodiments, the casting apparatus is a withdrawal mold.

One particular embodiment of a method for casting a metallic material according to the present disclosure includes: heating starting materials selected to provide a desired composition of the molten metallic material; refining the molten metallic material; flowing the molten metallic material along a receiving receptacle including at least two outflow regions defining different molten material pathways, wherein each outflow region is associated with a different casting position; and selectively heating metallic material on one of the at least two outflow regions with at least one of an electron beam gun and a plasma generating device, thereby directing molten metallic material to flow along the flow pathway defined by the heated outflow region. In certain non-limiting embodiments of the method, the molten metallic material has the composition of an alloy selected from a commercially pure titanium grade, a titanium alloy, a titanium-palladium alloy, a titanium-aluminum alloy, Ti-6Al-4V alloy, Ti-3Al-2.5V alloy, Ti-4Al-2.5V alloy, a niobium alloy; and a zirconium alloy.

It will be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A melting and casting apparatus comprising:

a melting hearth;

a refining hearth comprising an elongated shape comprising two short ends and two long sides, the refining hearth comprising an inflow region in communication with the melting hearth on one of the two long sides of the refining hearth, and an outflow region positioned lower than the inflow region;

a receiving receptacle comprising an elongated shape comprising two short sides and two long sides, the receiving receptacle directly fluidly communicating with the refining hearth on one of the two long sides of the receiving receptacle and on one of the two short ends of the refining hearth, thereby forming a generally T-shaped orientation between the refining hearth and the receiving receptacle wherein the long sides of the refining hearth form a non-perpendicular angle relative to the long sides of the receiving receptacle;

a casting chamber;

a translatable side wall removably coupled to the casting chamber, wherein the melting hearth, the refining hearth, and the receiving receptacle are connected to the translatable side wall; and at least one electron beam gun configured to direct electrons toward the receiving receptacle and regulate a direction of flow of molten material along a first molten material pathway through a first of the two short sides of the receiving receptacle and/or along a second molten material pathway through a second of the two short sides of the receiving receptacle.

2. The melting and casting apparatus of claim 1, wherein the melting hearth, the refining hearth, and the receiving receptacle are disposed within an enclosure that may be maintained under vacuum conditions.

3. The melting and casting apparatus of claim 1, further comprising:

a first casting mold positionable to receive molten material flowing along the first molten material pathway.

4. The melting and casting apparatus of claim 3, further comprising:

a second casting mold positionable to receive molten material flowing along the second molten material pathway.

5. The melting and casting apparatus of claim 4, wherein the first casting mold and the second casting mold are translatable to and from positions at which the casting molds can receive molten material from the receiving receptacle.

6. The melting and casting apparatus of claim 4, wherein at least one electron beam gun is positioned over the receiving receptacle and allows for the flow of molten material when an electron beam is emitted by the at least one electron beam gun.

7. The melting and casting apparatus of claim 1, wherein a position of the receiving receptacle is fixed relative to the refining hearth.

8. The melting and casting apparatus of claim 4, wherein the receiving receptacle is positioned so that molten material may flow from the receiving receptacle into the first casting mold or the second casting mold depending on a position and a power level of the at least one electron beam gun.

9. The melting and casting apparatus of claim 1, wherein the two short sides of the receiving receptacle comprise two opposed short sides, and wherein a spout is provided at each opposed short side.

10. The melting and casting apparatus of claim 1 comprising:

a first electron beam gun configured to direct electrons toward the receiving receptacle and regulate a flow of molten material along the first molten material pathway; and a second electron beam gun configured to direct electrons toward the receiving receptacle and regulate a flow of molten material along the second molten material pathway.

11. The melting and casting apparatus of claim 1, further comprising a plurality of electron beam guns arranged and selectively energizable to create a mixing action in the molten material.

12. The melting and casting apparatus of claim 10, wherein the first electron beam gun is equidistant between the first of the two short sides and a center of the receiving receptacle.

13. The melting and casting apparatus of claim 10, wherein the second electron beam gun is equidistant between the second of the two short sides and the center of the receiving receptacle.

14. The melting and casting apparatus of claim 1, further comprising:

a melting chamber, wherein the melting hearth is located in the melting chamber, wherein the receiving receptacle is located in the casting chamber; and wherein the refining hearth extends between the melting chamber and the casting chamber.

15. The melting and casting apparatus of claim 14, further comprising:

a first intake chamber to introduce starting materials into the melting chamber through a first side wall of the melting chamber; and a second intake chamber to introduce starting materials into the melting chamber through a second side wall of the melting chamber;

wherein the first side wall is located perpendicular to the second side wall.

* * * * *